United States Patent [19]

Taddia et al.

[11] Patent Number: 4,951,862

[45] Date of Patent: Aug. 28, 1990

[54] DISCRETE STRIP OF PAPER MATERIAL FROM WHICH TO FASHION A RIGID BOX WITH HINGED LID, IN PARTICULAR A FLIP-FLOP CIGARETTE PACKET, AND THE PACKET OBTAINED BY FOLDING SUCH A STRIP OF MATERIAL

[75] Inventors: Pierino Taddia, Pian di Macina-Pianoro; Silvano Boriani, Bologna, both of Italy

[73] Assignee: G.D. Societa per Azioni, Bologna, Italy

[21] Appl. No.: 454,981

[22] Filed: Dec. 22, 1989

[30] Foreign Application Priority Data

Dec. 23, 1988 [IT] Italy ..... 3709 A/88
Oct. 11, 1989 [IT] Italy ..... 3648 A/89

[51] Int. Cl.[5] ..... B65D 5/66
[52] U.S. Cl. ..... 229/160.1; 206/273; 229/146
[58] Field of Search ..... 229/160.1, 146; 206/271, 273

[56] References Cited

U.S. PATENT DOCUMENTS

| | | | |
|---|---|---|---|
| 3,944,066 | 3/1976 | Niepmann | 229/160.1 |
| 3,979,047 | 9/1976 | Focke et al. | 229/160.1 |
| 4,114,777 | 9/1978 | Fröhling et al. | 229/160.1 |
| 4,466,536 | 8/1984 | Zeitel | 229/160.1 |
| 4,742,955 | 5/1988 | Focke et al. | 229/160.1 |
| 4,852,734 | 8/1989 | Allen et al. | 229/160.1 |

*Primary Examiner*—Gary E. Elkins
*Attorney, Agent, or Firm*—Cushman, Darby & Cushman

[57] ABSTRACT

The strip is pre-creased to show the front, rear, sides, top and bottom of the packet, and provided with through cuts which combine with certain of the creases to create two pairs of top and bottom corner reinforcement tongues incorporated into the margins of the strip from which the sides of the box and lid are fashioned, each tongue being parted transversely by a cut parallel to and offset from the fold between the front and bottom faces of the box, and the front and top of the lid. The length of the top and bottom faces, measured across the packet from side to side, is reduced from the width of the front and rear faces of the box and the lid, and the top and bottom edges of the outermost side flaps of the box and lid are also cut short so as to remain distanced from the relative corners when the packet is folded into its final shape.

7 Claims, 4 Drawing Sheets

DISCRETE STRIP OF PAPER MATERIAL FROM WHICH TO FASHION A RIGID BOX WITH HINGED LID, IN PARTICULAR A FLIP-FLOP CIGARETTE PACKET, AND THE PACKET OBTAINED BY FOLDING SUCH A STRIP OF MATERIAL

BACKGROUND OF THE INVENTION

The present invention relates to a discrete strip of paperboard or card material from which to form a rigid container consisting in a box with a hinged lid, notably for wrapping cigarettes, and to the container obtainable by folding such a strip of material.

Containers of the type in question, recognizable in particular as 'flip-top' cigarette packets, are folded from die-cut cardboard strips of essentially rectangular shape which appear symmetrical in relation to a longitudinal axis and are divided up into a number of sections by creases and cuts.

The flat strip comprises a first section, destined ultimately to form the bottom of the box, and two further sections aligned in the direction of the longitudinal axis, one on either side of the first, constituting the front and rear faces of the box; two flaps are associated with each face, projecting one on either flank of the strip in a direction transverse to its longitudinal axis and disposed in parallel alignment with the longitudinal axis, which are folded into overlapping contact, those of the front face outermost and those of the rear face innermost, to form the sides of the box.

The strip comprises a further portion from which to fashion the lid; this portion comprises a section designed to form the top of the packet, which is located between two sections destined ultimately to provide the rear and front of the lid, the rear of the lid being separated from the rear face of the box by a hinge crease, and the front of the lid destined to register with the top edge of the front face of the box.

Two pairs of flaps project on either flank from the front and rear of the lid, respectively; these are designed ultimately to overlap, those of the front outermost and those of the rear innermost, thereby forming the sides of the lid.

The flat strip is completed by two pairs of tongues extending respectively from the inner side flaps of the box and the inner side flaps of the lid, which provide four reinforcements for the four relative corners of the packet, and a further tongue for reinforcement of the lid, which extends from the projecting transverse edge of the lid and is folded in against the relative inside surface.

The strip is folded by mechanical means operating in conjunction with glueing devices, by which the inner and outer flaps of the box and the lid are stuck together, and the reinforcing tongues folded in place at the top and the bottom corners of the packet, and against the inside surface of the front of the lid, respectively.

When packaging cigarettes, and indeed when wrapping other commodities, the product is protected further against the surrounding environment by enveloping the packet in a wrapping of heat-sealable film, for example cellophane.

A sheet of such film is first wrapped around the packet in tubular fashion, covering the front, rear and sides, and joined and sealed down one side. Thereafter, the ends of the tube are folded down over one another against the top and bottom of the box, and heat-sealed to envelop the packaged item completely. This operation is effected by means of heat-sealing devices that compact the overlapping thicknesses of film together, exploiting the sides of the packet, then the top and bottom, as a breast against which to apply the necessary pressure.

It has been discovered that errors occurring in the course of the packet's construction, for example due to incorrect execution of the creases or cuts during preparation of the strip of paper material, or to incorrect positioning of the inner and outer flaps of the box and lid one in relation to the other when folding and glueing, or again, due to incorrect assembly of the various sections of the packet, can give rise to imperfections; the top and bottom may project beyond the sides of the box and lid, or the horizontal edges of the side flaps may project respectively above and below the top and bottom of the packet; at all events, the end-result is that the defective side, top or bottom surface of the packet cannot be exploited successfully for heat-sealing purposes as mentioned above.

The result of such a shortcoming is to inhibit an accurate heat-seal of those parts of the cellophane which cover the side, top and bottom of the packet, and given that this condition will be detected by the conventional monitoring devices with which the cellophane wrapping units of cigarette production lines are normally equipped, the substandard pack of cigarettes may well be rejected altogether in consequence.

The object of the present invention is to overcome the drawbacks thus outlined through the provision of a discrete strip of paper material from which it will be possible to obtain flip-top packets that are free of defects pertinent to the prior art as mentioned above.

SUMMARY OF THE INVENTION

The stated object is realized, according to the present invention, with a strip of paper material from which to fashion rigid containers consisting in a box with a hinged lid, in particular flip-top cigarette packets, of the general type comprising a plurality of creases serving to define the front and rear faces and the innermost and outermost side face flaps of the box, the innermost and outermost side face flaps of the lid, the top and the bottom faces of the packet and the front face and relative reinforcing tongue of the lid, and a plurality of longitudinal first cuts combining with extensions of the respective creases between the bottom and rear faces of the box and between the top and rear faces of the lid to create two pairs of tongues, located externally of and in alignment with the top and bottom faces as part of marginal portions on either side of the strip from which the side flaps of the box and the lid are folded, and destined ultimately to reinforce the top and bottom faces.

The strip according to the invention comprises a plurality of second cuts combining with the first cuts to complete the creation of the reinforcing tongues, which are effected transversely to the strip, in positions adjacent to and offset from the creases between the bottom and front faces of the box and between the top and front faces of the lid, in such a way as to shorten the length of the outermost side flaps of the box and the lid in relation to the respective innermost side flaps, and in that the length dimension of the top and bottom faces of the finished packet, measured transversely to the longitudinal axis of the strip, is less than the corresponding width dimension of the front and rear faces of the box and lid.

With a strip thus embodied, particularly small amounts of waste are generated, and the reduced length of the outer side flaps of the box and lid sections is offset by the increased length of the tongues that reinforce the top and bottom corners. Moreover, by embodying the innermost side flaps of the box and the lid integral with the reinforcing tongues at the relative corners, the packet remains securely enclosed, preventing any exposure of the contents.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
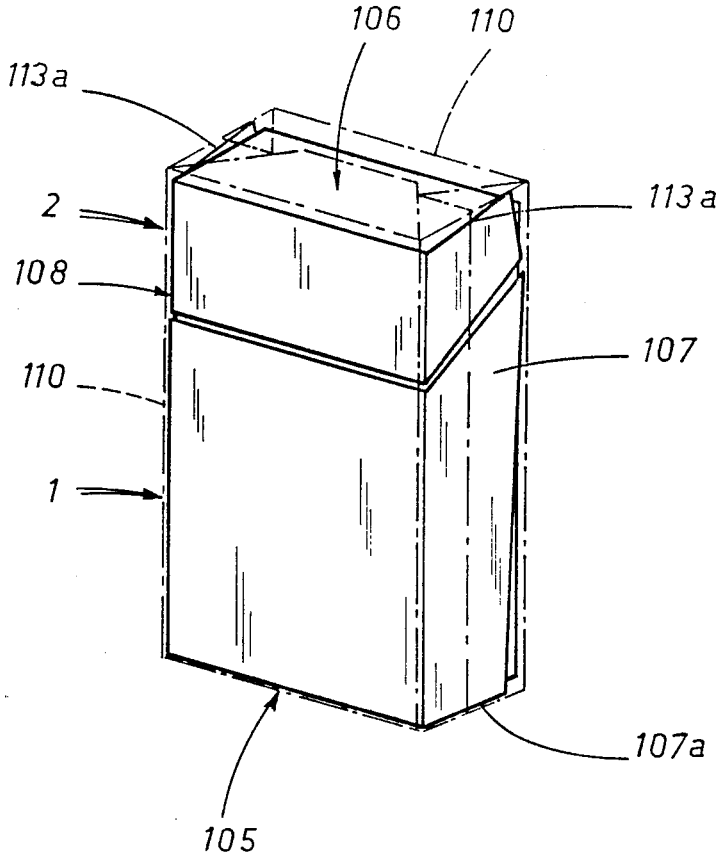
FIGS. 1 and 2 are perspectives of a packet obtainable from a conventional strip of material, in which the drawbacks aforementioned are exaggerated by way of illustration.
Figure 2:
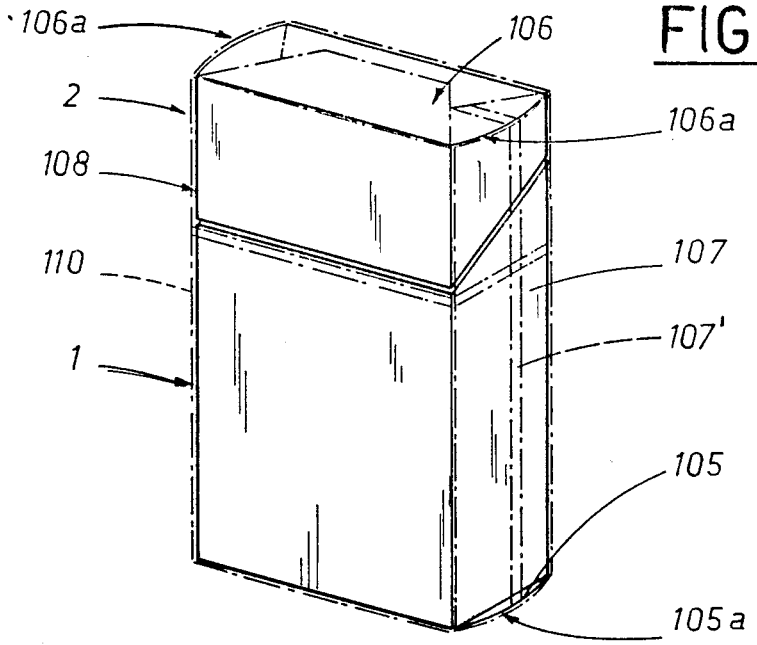

FIGS. 1 and 2 show a closed packet of substantially parallelepiped shape, which is of the conventional flip-top embodiment consisting in a box 1 with a hinged lid 2.

105 and 16 denote the ends of the packet, bottom and top respectively, whilst 107 and 108 denote the two sides.

The phantom line denoted 110 represents an outer covering of transparent material wrapped initially as a tube enveloping the longitudinal faces of the packet and sealed along one side 107, then folded flat and sealed against the ends 105 and 106.

Referring first to FIG. 1, one of the drawbacks it is sought to remedy, according to the invention, consists in the possibility that the top and bottom edges 113*a* and 107*a* of the sides 107 of the lid 2 and the box 1 project longitudinally above and below the respective ends 106 and 105, the effect of which is to disallow the heat-seal devices, by which the end folds of the outer wrapper 110 are overlapped and fastened, from exploiting the two ends 105 and 106 as a pressure surface.

The other drawback the invention seeks to overcome, which is similar in practice to the drawback first mentioned albeit encountered in different parts of the packet, arises in the event that the edges 105*a* or 106*a* of the bottom or the top end 105 or 106 of the packet should project transversely beyond the plane occupied by the sides, in particular as shown in FIG. 2, in the case of the side denoted 107.

Should this occur, in fact, any such projection of the edges 105*a* and 106*a* in question will prevent a heat-seal device from breasting cleanly with the side face 107, given that the tubular wrapping 110 is joined initial along this side of the packet in an overlap denoted 107', and a disjointed, hence substandard seal is the result.

A strip of paper material creased and cut according to the present invention is capable of overcoming the drawbacks described and illustrated in FIGS. 1 and 2, inasmuch as the first edges mentioned 107*a* and 113*a* are cut and folded in such a way as to avoid their intersecting the planes occupied by the bottom and top ends 105 and 106 of the packet, and the edges denoted 105*a* and 106*a* are prevented from projecting beyond the relative sides 107 and 108.

Generally considered (see FIG. 3 and FIG. 5), the strip is divided up by a plurality of transverse and longitudinal creases 3', 3'', 4', 4'', 6', 6'', 13', 14', 16' and 18' variously defining the front face 4 and the rear face 3 of the box 1, the bottom end 5 and top end 6, the inner side flaps 7, 8 and outer side flaps 7*a*, 8*a* of the box 1, the inner side flaps 13, 14 and outer side flaps 13*a*, 14*a* of the lid 2, the rear 18 of the lid 2, and finally, the front face 15 of the lid 2 and its reinforcing tongue 16.

To fashion the box, the front and rear 4 and 3 are first folded in relation to the bottom end 5 along the respective parallel creases 4' and 3' whereupon the two sets of side flaps 7, 8 and 7*a*, 8*a* are folded respectively foward and back, the latter remaining outermost, along the longitudinal creases denoted 3'' and 4'' which separate them from the rear and front 3 and 4.

As regards the top part of the packet incorporating the lid 2, the top end 6 is folded at right angles to the rear 3 of the box along the crease 6' which establishes the top edge of the rear 18 of the lid. The front 15 is then folded at right angles to the top 6 along the crease 6'' that coincides with the top front edge of the packet, and the reinforcing tongue 16 folded inwards, flat against the inside surface of the front 15.

The innermost flaps 13 and 14 of the lid 2 are bent forward along the creases 13' and 14' that separate them from the rear 18, whereupon the outer flaps 13*a* and 14*a* are folded back along the corresponding creases 13' and 14' that separate them from the front 15, to overlap the inner flaps 13 and 14.

In order to allow for the hinged flip-top movement of the lid 2 in relation to the box 1, the inner flaps 13 and 14 of the lid are detached from the corresponding flaps 7 and 8 of the box by cuts 17 departing one from each end of the hinge crease 18' between the box 1 and lid 2, and extending across the entire width of the two marginal, or flank portions of the strip that comprise the inner and outer flaps 7–8, 7*a*–8*a*, 13–14 and 13*a*–14*a*.

The cuts 17 will be seen to be angled, and parallel to the ends 19 of the inner flaps 7*a*–8*a*, 13*a*–14*a*. 11 and 12 denote two pairs of tongues serving to reinforce the corners at the bottom end 5 and the top end 6 of the packet, respectively; each end 5 and 6 and the relative pair of tongues 11 and 12 are disposed substantially in transverse alignment across the strip, and separated one from the other by relative longitudinal cuts 9.

In folding the packet, the tongues denoted 11 are bent at right angles to the relative sides 7 and 8 of the box and brought into overlapping contact with the inside surface of the bottom end 5, whilst the tongues denoted 12 are folded at right angles to the lid flaps 13 and 14, thus entering into contact with the inside surface of the top end 6.

According to the present invention, each tongue 11 and 12 is obtained by effecting two cuts in the strip, the first, denoted 9, in alignment with the longitudinal creases 3'' and 4'' that separate the faces and sides of the box. The second cut 10 is located adjacent to, though not in alignment with the creases 4' and 6'' between the bottom end 5 and the front face 4 of the box, and between the top end 6 and the front 15 of the lid, respectively.

Instead, the second cuts 10 are offset, positioned so as to reduce the length L' of the outer flaps 7*a* and 8*a* of the box 1 in relation to the length L of the internal flaps, and similarly, to reduce the length L″ of the outer lid flaps 13*a* and 14*a* in relation to the inner lid flaps 13 and 14.

Figure 4:
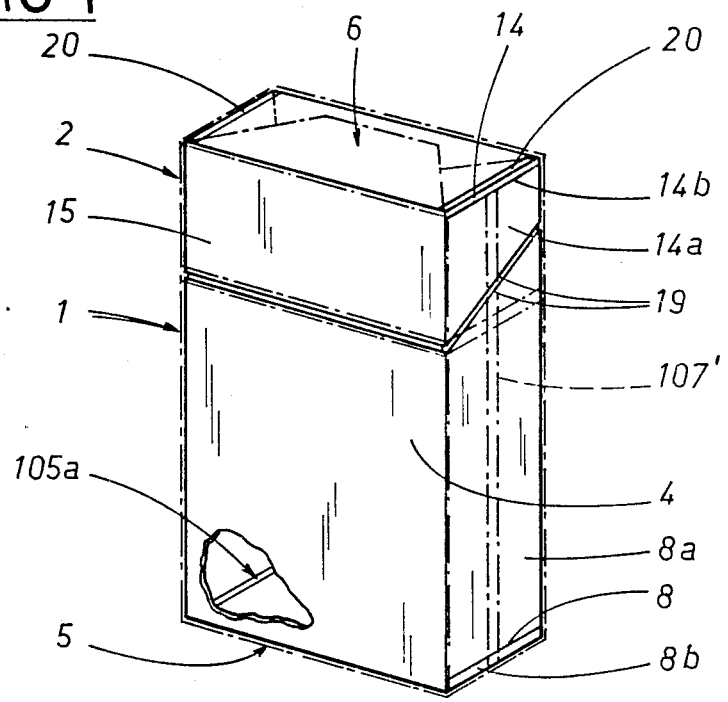
FIG. 4 is the perspective of a packet according to the invention, folded from the strip of FIG. 3 and illustrated in the same scale as that of FIG. 1.

The effect of such an expedient is to produce a folded packet (see FIG. 4) in which the horizontal edges 7*b*, 8*b* and 13*b*, 14*b* of the outer flaps 7*a*, 8*a* of the box 1 and the outer flaps 13*a*, 14*a* of the lid 2, respectively, are unable to project beyond the planes occupied by the relative bottom and top ends 5 and 6; accordingly, even errors of the type illustrated in FIG. 1 will not affect the operation of heat sealing devices used to flatten and fasten the end folds of an outer cellophane wrapper.

A further feature of the invention is that the breadth of the bottom end 5 and the top end 6 of the packet, i.e. the length measured transversely to the longitudinal axis of the strip, is less than the corresponding dimension of the front and rear faces 4, 15 and 3, 18 of the box and the lid.

Figure 3:
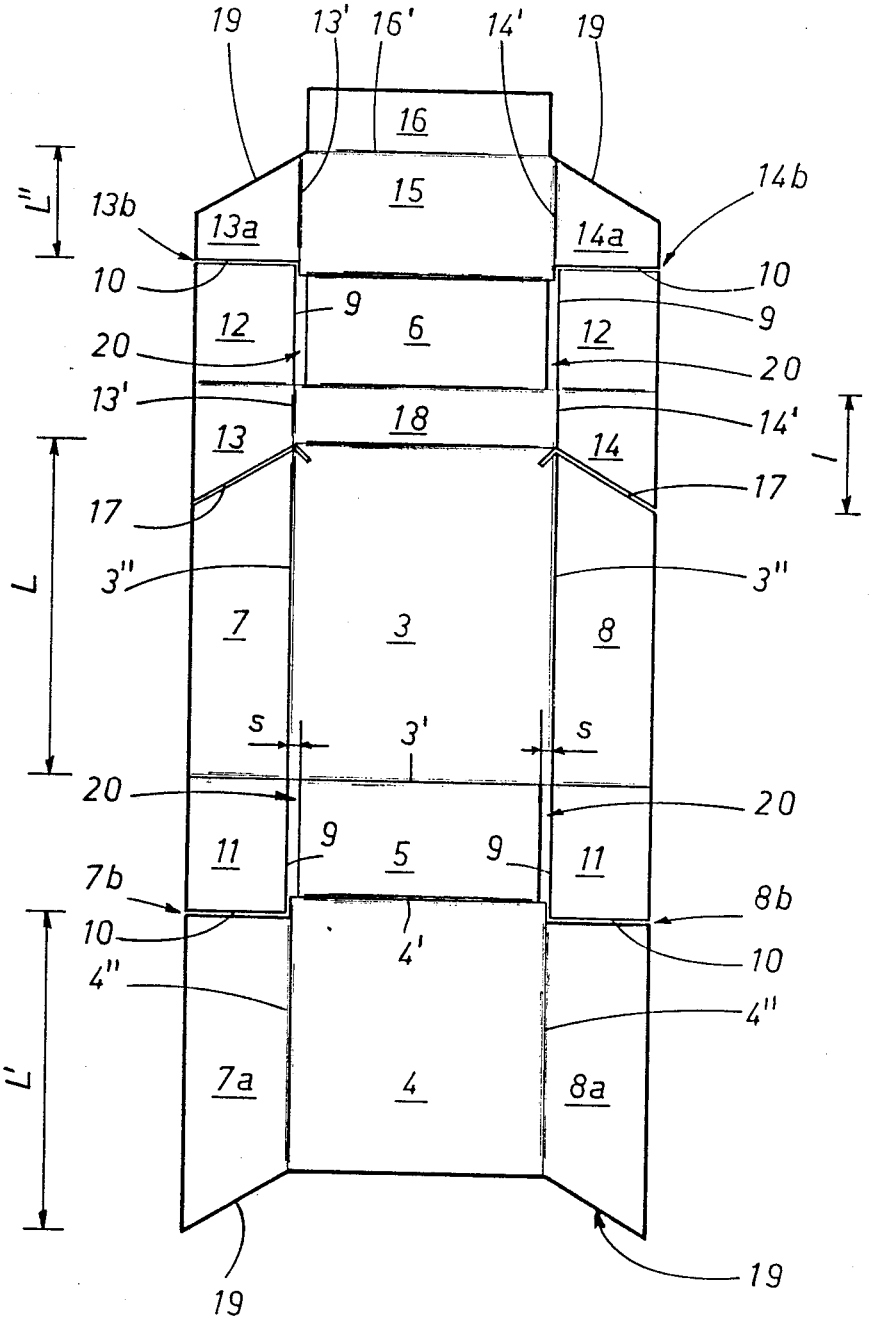
FIG. 3 shows a plan of the strip of paper material according to the invention, seen in its unfolded state.

It will be seen in FIG. 3 that either one or both of the unattached edges of each end 5 and 6 exhibits a cutaway, or recessed portion 20, the presence of which effectively determines the desired reduction in transverse length.

In the event of there being two cutaways 20 to each end 5 and 6, these will be symmetrically disposed, one on either side of the longitudinal axis of the strip.

The cutaways 20 are of substantially rectangular shape and will be of width, i.e. measured through the transverse axis of the strip and denoted 's' in FIG. 3, equivalent to at least twice the thickness of the strip material.

Figure 5:
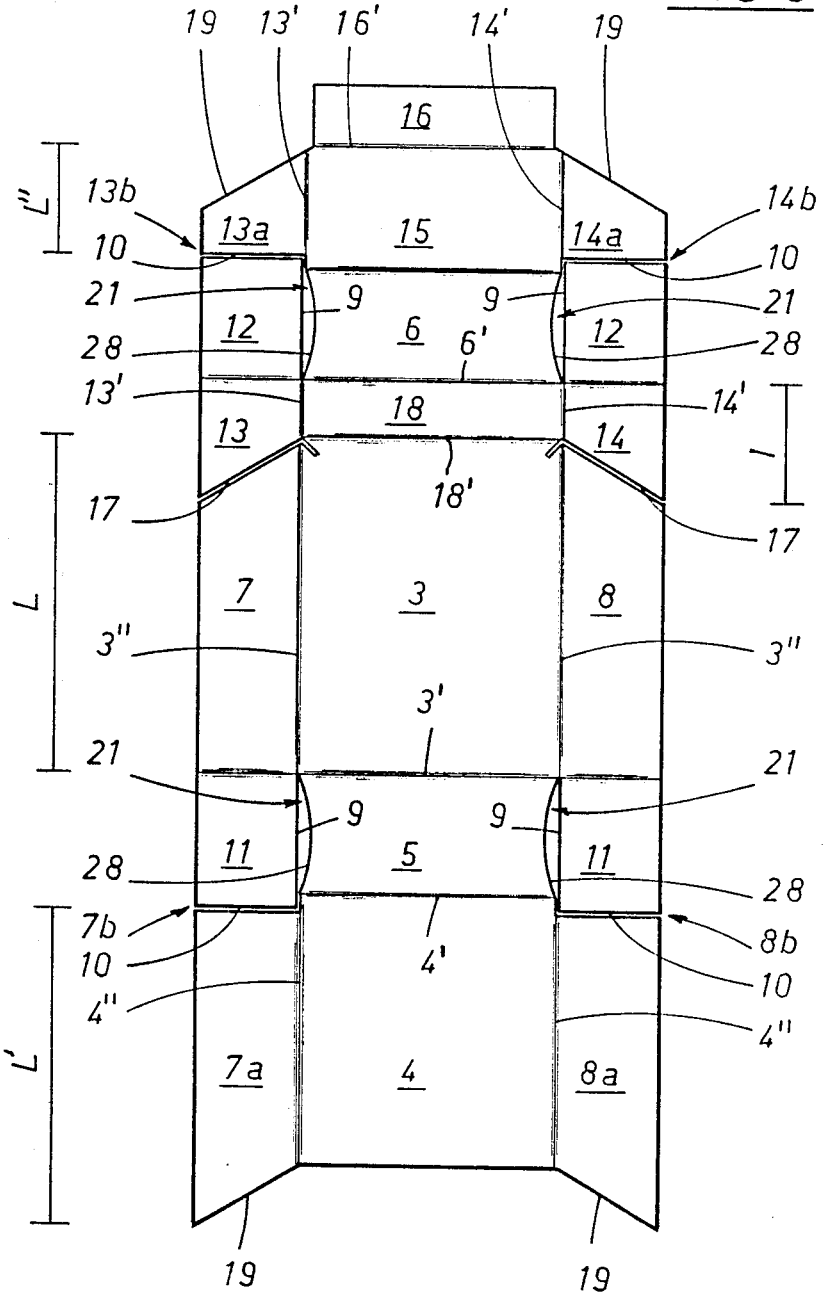
FIG. 5 shows an alternative embodiment of the strip of paper material illustrated in FIG. 3.

In an alternative embodiment, illustrated in FIG. 5, the cutaway or recessed portions 21 exhibit a segmental profile 28 of which the curved side is directed toward the relative end 5 and 6.

The effect of this further expedient is to produce a folded packet (see FIG. 4) in which the unattached edges of the bottom and top ends 5 and 6, whether cut away to a rectilinear or curvilinear profile 20 or 21, are disposed internally of the longitudinal creases 3″, 4″, 13′, 14′ of the various flaps 7–8, 7*a*–7*d* 13–14 and 13*a*–14*a*; thus, even errors of the type depicted in FIG. 1 cannot affect the operation of heat-sealing devices used to flatten and fasten the overlapping longitudinal edges of an outer cellophane wrapper.

It will be observed that the two features according to the present invention, considered separately, essentially reflect a single expedient applied to different points of the one folded packet.

The stated objects of the invention are thus amply realized; the discrete strip of material disclosed can be prepared with a bare minimum of waste, and undergoes no essential alteration in fundamental embodiment with respect to conventional flip-top pack die-cuts of the type in question.

What is claimed is:

1. A discrete strip of paper material from which to fashion a rigid packet of the type consisting in a box and a hinged lid, identifiable in particular as a flip-top pack for cigarettes, comprising:

a plurality of creases serving to define the front and rear faces and the innermost and outermost side face flaps of the box, the innermost and outermost side face flaps of the lid, the top and the bottom faces of the packet and the front face and relative reinforcing tongue of the lid, of which the top and bottom faces exhibit a length dimension, measured transversely to the longitudinal axis of the strip, less than the corresponding width dimension of the front and rear faces of the box and lid;

a plurality of longitudinal first cuts combining with extensions of the respective creases between the bottom and rear faces of the box and between the top and rear faces of the lid to create two pairs of tongues, located externally of and in alignment with the top and bottom faces as part of marginal portions on either side of the strip from which the side flaps of the box and lid are folded, and destined ultimately to reinforce the top and bottom faces;

a plurality of transverse second cuts combining with the first cuts to complete the creation of the reinforcing tongues, which are effected normal to the longitudinal axis of the strip in positions adjacent and offset from the creases between the bottom and front faces of the box and between the top and front faces of the lid, in such a way as to shorten the length of the outermost side flaps of the box and the lid in relation to the respective innermost side flaps.

2. A discrete strip of paper material as in claim 1, wherein the second cuts extend parallel with the creases between the bottom and front faces of the box and the top and front faces of the lid.

3. A discrete strip of paper material as in claim 1, wherein at least one of the unattached edges of the bottom and top faces of the packet is cut away to a depth equivalent to at least twice the thickness of the paper material, in such as way as to obtain a corresponding reduction in the length dimension of the bottom and top faces, measured transversely to the longitudinal axis of the strip.

4. A discrete strip of paper material as in claim 1, wherein both unattached edges of the bottom and top faces of the packet are cut away symmetrically in relation to the longitudinal axis of the strip, each to a depth equivalent to at least twice the thickness of the paper material, in such as way as to obtain a corresponding reduction in the length dimension of the bottom and top faces, measured transversely to the longitudinal axis of the strip.

5. A discrete strip of paper material as in claim 3, wherein the area cut away from each edge of the top and bottom of the packet is of segmental geometry.

6. A discrete strip of paper material as in claim 3, wherein the area cut away from each edge of the top and bottom faces of the packet is of rectangular geometry.

7. A box with a hinged lid, in particular a flip-top container as utilized for packaging cigarettes, obtainable by folding a pre-creased strip of paper material, of which the outermost side flaps of the box and the outermost side flaps of the lid terminate longitudinally without intersecting the planes occupied by the bottom face of the box and the top face of the lid, respectively, and the bottom face of the box and the top face of the lid are of length, measured transversely to the longitudinal axis of the pre-creased strip, less than the corresponding width dimensions of the front and rear faces of the box and of the lid.

* * * * *